United States Patent [19]

Lynde et al.

[11] Patent Number: 4,776,394

[45] Date of Patent: Oct. 11, 1988

[54] HYDRAULIC STABILIZER FOR BORE HOLE TOOL

[75] Inventors: Gerald D. Lynde, Bossier City; Benjamin E. Foster, Shreveport, both of La.

[73] Assignee: Tri-State Oil Tool Industries, Inc., Bossier City, La.

[21] Appl. No.: 14,482

[22] Filed: Feb. 13, 1987

[51] Int. Cl.[4] ..... E21B 29/00; E21B 17/10

[52] U.S. Cl. ..... 166/55.8; 166/241; 175/269; 175/325

[58] Field of Search ..... 166/55.6, 55.8, 241, 166/242; 175/76, 269, 320, 325

[56] References Cited

U.S. PATENT DOCUMENTS

| | | | |
|---|---|---|---|
| 2,061,316 | 11/1936 | Brack et al. | 175/76 |
| 3,098,534 | 7/1963 | Carr et al. | 175/325 |
| 3,273,645 | 9/1966 | Der Mott | 166/212 |
| 3,370,657 | 2/1968 | Antle | 166/241 |
| 3,376,927 | 4/1968 | Brown | 166/55.8 |
| 3,664,416 | 5/1972 | Nicolas et al. | 166/212 |

*Primary Examiner*—Stephen J. Novosad
*Assistant Examiner*—Terry Lee Melius
*Attorney, Agent, or Firm*—Dodge, Bush & Moseley

[57] ABSTRACT

A stabilizer (36) mounted on a mandrel (14) of a workstring (12) within a casing (10) of a well bore hole. The stabilizer (36) has an upper carrier (38) fixed to the mandrel (14) and a lower carrier (40) mounted on the mandrel (14) for relative sliding movement. Shoes (70) are mounted by links or arms (64, 74) to bearing housing (50, 80) on the carriers (38, 40). The bearing housings (50, 80) are mounted for relative rotation on the carriers (38, 40) and permit the mandrel (14) and workstring (12) to rotate relative to the shoes (70) upon fluid actuation of lower carrier (40) and engagement of the casing (10) by the shoes (70).

8 Claims, 3 Drawing Sheets

HYDRAULIC STABILIZER FOR BORE HOLE TOOL

BACKGROUND OF THE INVENTION

This invention relates to a tool assembly for connection to a drill string within a bore hole for oil and gas wells, and more particularly to a hydraulic stabilizer for such a tool assembly which may be expanded radially to engage the inner periphery of the bore hole or casing defining the bore hole.

Heretofore, with certain well tools, such as cutting tools for cutting pipe or casing previously installed within a well, it is desirable to center and stabilize the cutting tools particularly within large diameter casing. When the stabilizer is fixed for rotation with the mandrel and cutters, the cutting blades on the tool tend to impact or vibrate continuously against the inner periphery of the casing. Thus, it is highly desirable that any stabilizer be stationary when set within the casing so that the mandrel and associated tool may rotate relative to the stabilizer which acts as an anchoring means to center the mandrel and minimize any lateral movement thereof while permitting relative rotation.

Several types of radially expandable shoes have been employed for stabilizing or centralizing various types of tools within a well bore. For example, U.S. Pat. No. 3,098,534, dated July 23, 1963 shows a drill string for directional drilling having a mandrel thereon and an outer tube on the mandrel carrying a hydraulically actuated shoe which may be radially expanded and contracted. The shoe is adapted particularly for directional drilling and is mounted on one side of the drill string for deflection of the drill bit while permitting relative rotation of the mandrel.

U.S. Pat. No. 3,370,657, dated Feb. 27, 1968 likewise shows a stabilizer for a well tool having radially expandable shoes adapted to engage the inner periphery of the well bore while permitting rotation of the drill string and bit. The shoes are carried or mounted on a carriage which is movable downwardly for setting the shoes and movable upwardly for retraction of the shoes. The shoes are utilized particularly for radial shifting of the bit in directional drilling.

Other references show other various types of centralizers or stabilizers such as in U.S. Pat. No. 3,664,416, dated May 23, 1972; U.S. Pat. No. 3,273,645, dated Sept. 20, 1966; and U.S. Pat. No. 4,557,327, dated Dec. 10, 1985. However, these additional references do not show a centralizer or stabilizer mounted on a mandrel and being radially expandable to engage the inner periphery of an adjacent casing or the like in fixed relation while permitting relative rotation of the mandrel.

SUMMARY OF THE INVENTION

The present invention is directed to a hydraulic stabilizer or centralizer for connection to a workstring in a well bore such as a workstring having cutting blades for cutting well casing or the like. A mandrel at the lower end of the workstring has spaced upper and lower sleeve-like bearing carriers mounted thereon with the lower bearing carrier being mounted for longitudinal movement along the mandrel toward and away from the upper bearing carrier. The upper and lower carriers have bearing housings mounted thereon for relative rotation and links are pivotally mounted on the housings. The links are connected to a plurality of circumferentially spaced pads or shoes which move radially outwardly between the spaced carriers to engage the inner perimeter of the adjacent casing. For movement of the shoes radially outwardly, fluid pressure from the bore of the tubular mandrel is exerted against the lower bearing carrier to move the lower bearing carrier upwardly toward the upper bearing carrier along with the associated bearing housing and links thereby to move the shoes outwardly into fixed engagement with the inner periphery of the outer casing for centering the mandrel within the casing. During the work operation, such as the cutting of casing, the mandrel and associated cutting blades rotate relative to the shoes while the shoes are engaged thereby to effect the work operation while the shoes hold the mandrel centered and minimize any lateral movement thereof relative to the casing.

It is an object of the present invention to provide a fluid operated stabilizer or centralizer for a workstring in a well bore and is radially expandable for engaging the inner periphery of the casing or the well bore.

It is a further object of the invention to provide such a stabilizer including a plurality of circumferentially spaced shoes which are expanded or collapsed selectively by the exertion of hydraulic pressure thereby to permit the stabilizer to fit within restricted internal diameters of bores or the like.

A further object of the invention is to provide such a stabilizer having radially expandable shoes that are easily mounted on spaced upper and lower sleeve-like carriers about a mandrel for relative rotation.

Other objects, feature, and advantages of this invention will become more apparent after referring to the following specification and drawings.

Figure 1:
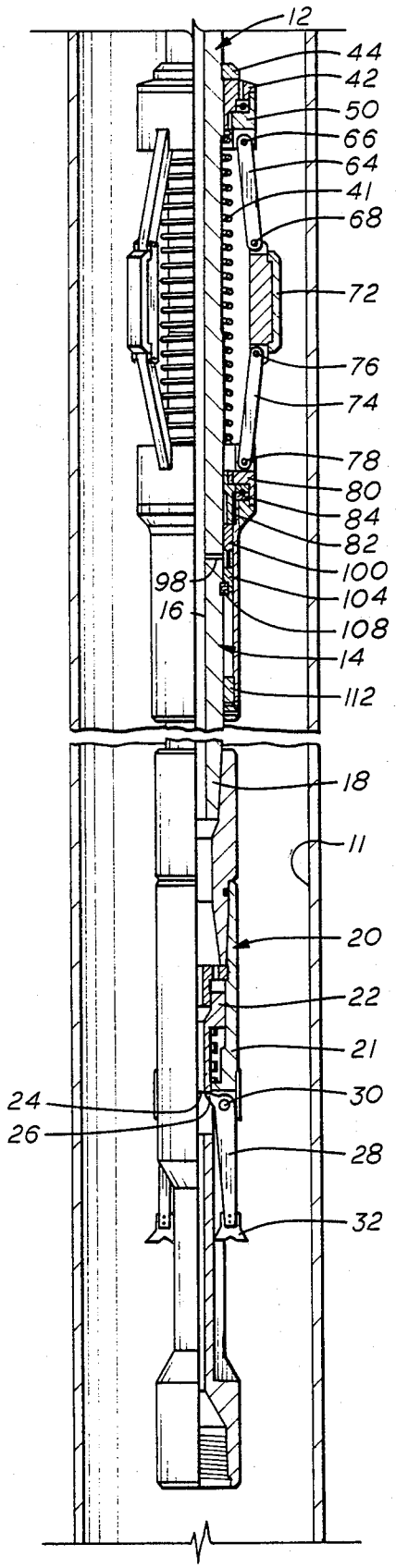
FIG. 1 is a longitudinal section view with certain parts shown in elevation of a workstring within an outer casing of a well bore with cutter blades shown on the lower end of the workstring mounted below the hydraulic stabilizer or centralizer of the present invention and showing the stabilizer in a retracted or collapsed position.
Figure 2:
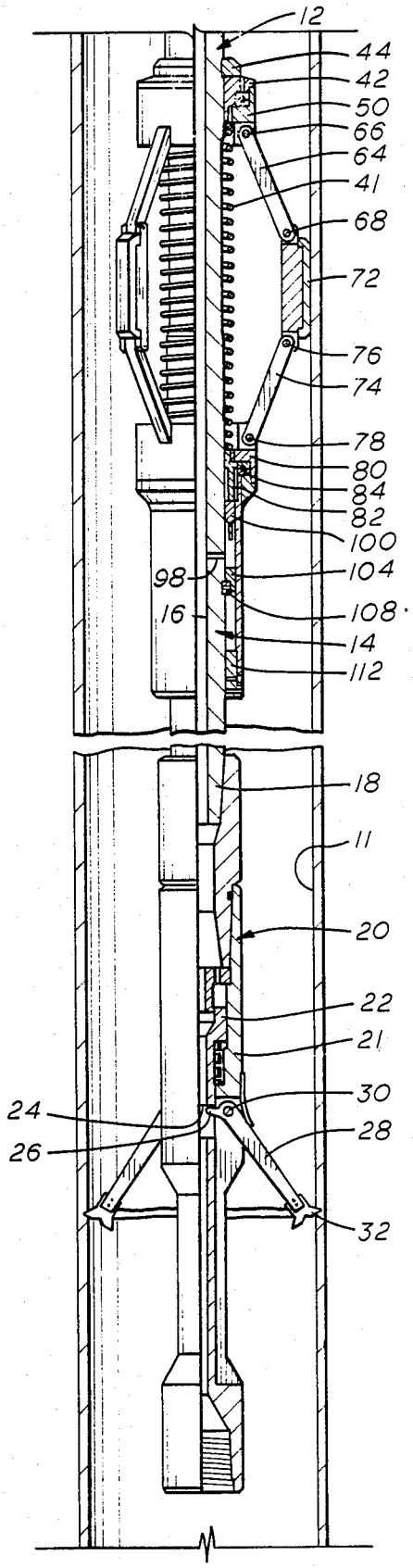
FIG. 2 is a longitudinal sectional view similar to FIG. 1 but showing the hydraulic stabilizer in a radially expanded position engaging the inner periphery of the casing to hold the workstring in a laterally fixed position while the mandrel and outwardly expanded cutter blades rotate relative to the stabilizer.
Figure 3:
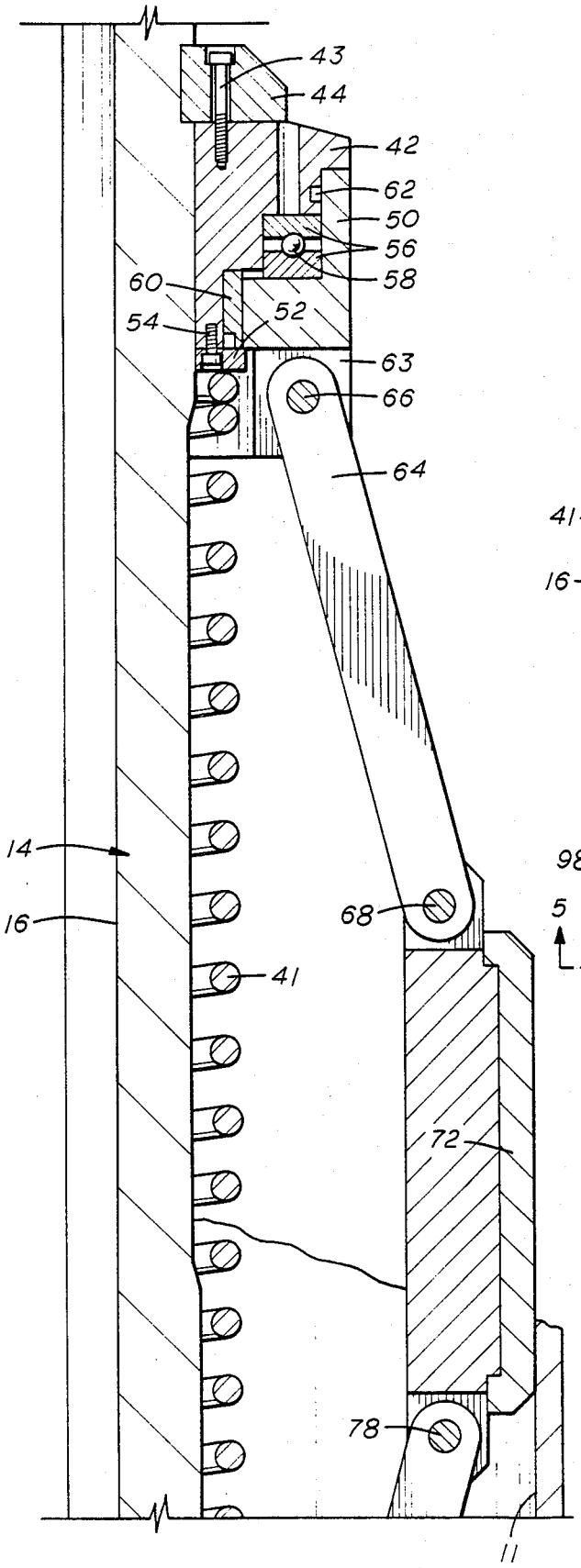
FIG. 3 is an enlarged fragment of FIG. 2 showing the longitudinally fixed upper sleeve-like carrier mounted on the mandrel.
Figure 4:
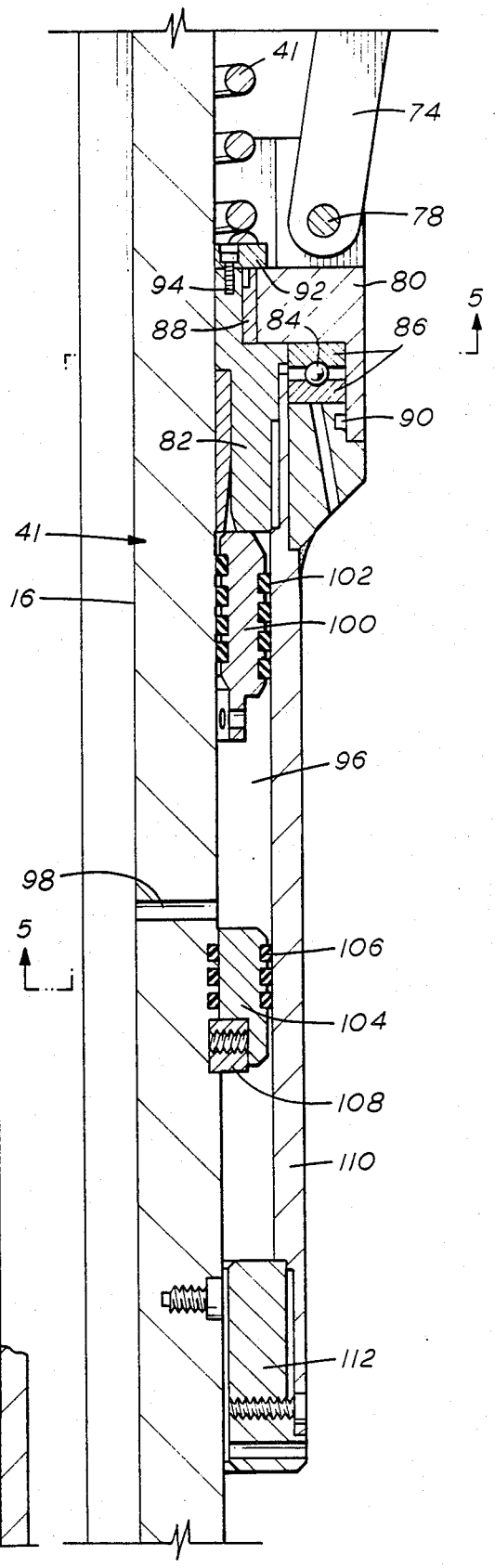
FIG. 4 is an enlarged fragment of FIG. 2 showing the longitudinally movable lower sleeve-like carrier mounted on the mandrel.
Figure 5:
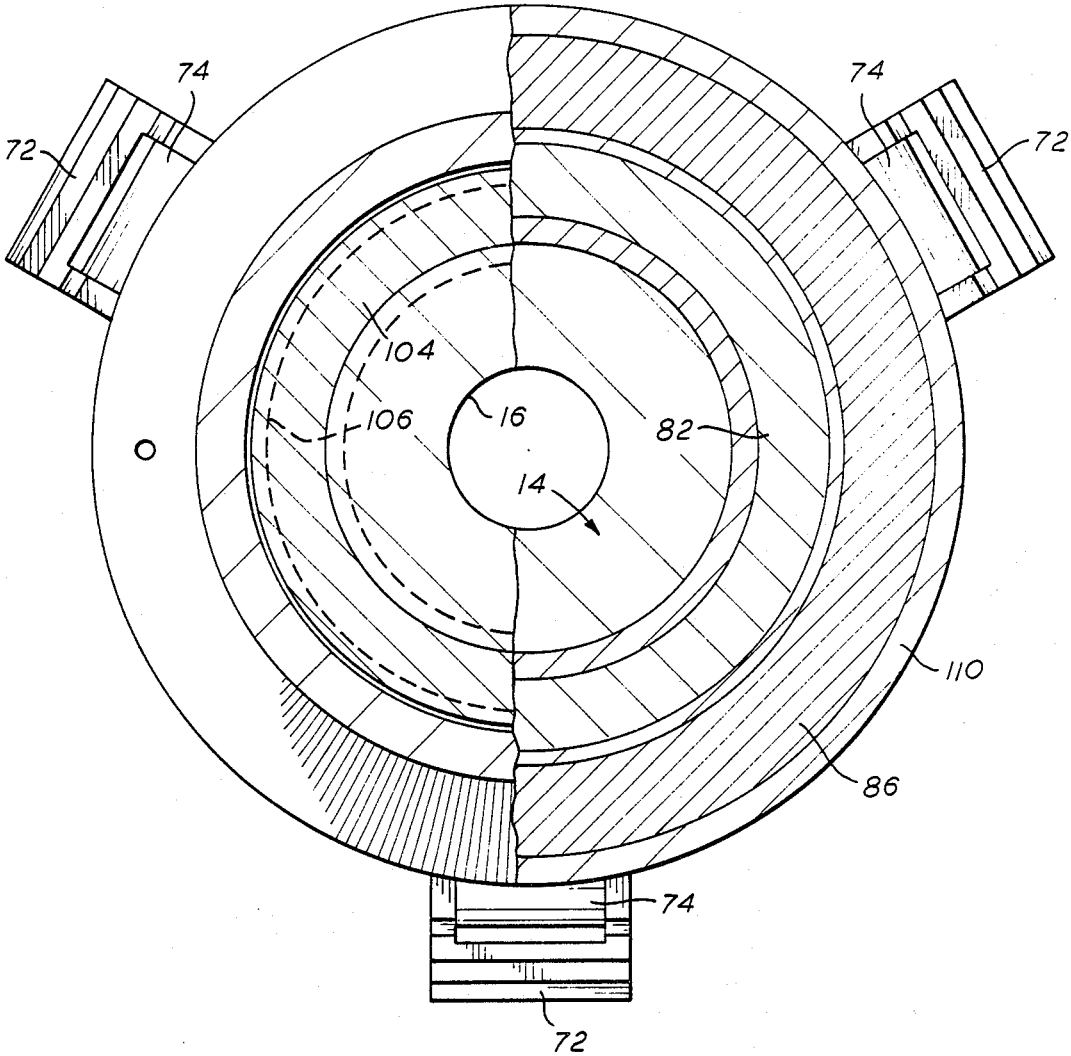
FIG. 5 is a section taken generally along line 5—5 of FIG. 4.

Referring now to the drawings for a better understanding of this invention, and more particularly to FIGS. 1 and 2, a well casing shown generally at 10 has been previously positioned within a well bore hole and has an inner periphery 11. A workstring 12 which has been lowered within casing 10 includes a lower tubular body or mandrel 14 having a central bore 16 and a lower threaded end 18 connected to a cutting tool generally indicated at 20. Cutting tool 20 has a tubular body 21 receiving a fluid pressure actuated piston indicated generally at 22 having a lower end 24 in contact with extensions or tangs 26 on the upper end of cutter arms 28. Cutter arms 28 are pivotally mounted at 30 within outwardly facing slots in cutter body 21. Arms 28 have cutter blades indicated generally at 32 at their lower ends and are adapted to swing outwardly into cutting relation with inner periphery 11 of casing 10 for cutting casing 10 at a desired location upon the exertion of fluid pressure against piston 22 from pressurized fluid within bore 16. The downward movement of piston 22 swings arms 28 outwardly with blades 32 engaging casing 10 in cutting relation. Blades 32 have a leading planar face preferably inclined rearwardly with respect to the direction of rotation and a plurality of hard carbide cutting discs are mounted on the leading face of blade 32 for forming the cutting surface. Cutter 20 may be utilized for cutting several concentric casing strings while utilizing the same cutter arms 28.

In order to center cutting tool 20 within a large diameter casing 10 and to restrict any lateral movement thereof during the cutting operation which would tend to minimize shock vibrations and reduce impact loading against the inner periphery of the casing, it is desirable to have a stabilizer mounted above the cutting tool. For this purpose, a stabilizer generally indicated at 36 is mounted on mandrel 14 above cutting tool 20. Stabilizer 36 includes an upper carrier generally indicated at 38 which is fixed to mandrel 14 and a lower carrier 40 which is adapted to slide longitudinally along mandrel 14. A compression spring 41 mounted about mandrel 14 between upper carrier 38 and lower carrier 40 continuously urges lower carrier 40 to a downward retracted position. Carrier 38 includes an annular carrier body 42 secured by bolts 43 to an upper split ring 44 mounted within an annular slot 46 in mandrel 14. An outer bearing housing 50 is mounted on carrier body 42 and a lower retaining ring 52 holds bearing housing 50 thereon. Ring 52 is secured to carrier body 42 by suitable bolts 54. Ball bearing races 56 have ball bearings 58 therebetween and mount outer bearing housing 50 for rotation relative to body 42. Bushing 60 and O-ring 62 are mounted between carrier body 42 and outer housing 50.

Mounted in slots 63 circumferentially spaced at one hundred twenty (120) degrees about the periphery of bearing housing 50 are a plurality of arms 64 connected by pins 66 to housing 50. The lower ends of arms 64 are pivotally mounted at 68 to shoes 70 having an outer pad 72 adapted to engage inner periphery 11 of casing 10. Lower arms 74 have their upper ends pivotally mounted at 76 on the lower side of shoes 70. The lower ends of arms 74 are pivotally mounted at 78 to a lower bearing housing 80 of lower carrier 40. Bearing housing 80 is mounted for rotation on lower carrier body 82 by ball bearings 84 positioned between races 86. A bushing 88 is provided between carrier body 82 and outer bearing housing 80 and an O-ring 90 is positioned between carrier body 82 and outer bearing housing 80. A retaining ring 92 holds outer housing 80 on body 82 by suitable retaining bolts 94. A piston chamber is shown at 96 connected by a fluid port 98 through mandrel 14 to the central bore 16 thereof for receiving fluid pressure therefrom for actuation of lower carrier 40. A piston 100 having a plurality of seals 102 thereabout is mounted within piston chamber 96 and moves upwardly upon pressurized fluid being provided in piston chamber 96 for urging carrier 40 upwardly relative to mandrel 14. A lower sealing member 104 has seal rings 106 thereabout for sealing piston chamber 96. A split ring 108 on mandrel 14 holds sealing member 104 in a fixed position. An outer sleeve 110 forms a cylindrical piston housing to define piston chamber 96 and extends from carrier body 82. A nut 112 is secured to the lower end of sleeve 110. Upon upward movement of carrier 40 along mandrel 14, nut 112 engages ring 108 in abutting relation to form a stop limiting such upward movement.

In operation, when stabilizer 36 is utilized with a cutting tool as shown in FIG. 1, the workstring is lowered within casing 10 to the depth where is desired to make a cut. At this location fluid pressure from a surface pump is increased and flows from bore 16 through port 98 to piston chamber 96 thereby to urge piston 100 and lower carrier 40 upwardly along mandrel 14 toward upper carrier 38 which remains in a fixed position. Upon upward movement of carrier 40 shoes 70 are forced outwardly for engaging the inner periphery 11 of casing 10 and are maintained in this position by fluid pressure during the work operation. Fluid pressure likewise urges cutter arms 28 outwardly with blades 32 engaging casing 10. Upon rotation of the workstring, mandrel 14 along with upper carrier body 42 and lower carrier body 82 rotate relative to bearing housings 50 and 80 which have arms 64 and 74 mounted thereon. Upon a decrease in fluid pressure, cutting arms 28 swing inwardly out of cutting relation. Also, compression spring 41 urges lower carrier 40 to a downward position in which shoes 70 are retracted.

Such a stabilizer permits a single stabilizer to be utilized with various diameters of casing since it may expand laterally a substantial distance from the outer surface of the workstring. When fluid pressure is reduced by dropping of the pumping action, shoes 70 will return to retracted position under the influence of spring 41 along with lower carrier 40. The shoes 70 by having a resilience act as a shock absorber during the cutting operation and thereby tend to reduce shock vibrations and excessive wear on the cutting tool.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In an apparatus for stabilizing a tubular string within a casing in a well bore;

a cylindrical tubular mandrel adjacent an end of the string;

a pair of sleeve-like carriers mounted on said mandrel in longitudinally spaced relation to form upper and lower carriers, one of said carriers being mounted for sliding movement along the mandrel toward and away from the other carrier;

each of said carriers including a body secured to said mandrel for rotation therewith, a housing mounted on the body, and bearing means between the body and housing permitting relative rotation therebetween;

a plurality of circumferentially spaced shoes mounted between the carriers positioned radially outwardly of said mandrel and adjacent the inner peripheral surface of the casing;

separate linkage means for each of the carriers extending between the shoes and the housing of each carrier for urging said shoes radially outwardly into engagement with the inner peripheral surface of said casing upon longitudinal movement of said one carrier along the mandrel toward the other carrier and permitting rotation of the mandrel and carrier bodies relative to the shoes when said shoes are in engagement with the casing; and fluid pressure actuated means associated with said one carrier and responsive to fluid pressure from the mandrel to urge said one carrier along the mandrel toward the other carrier for radially expanding said shoes.

2. In apparatus for stabilizing a tubular string as set forth in claim 1 wherein said fluid pressure actuated means comprises a piston within a piston chamber adjacent said one carrier, and a fluid port extending between the piston chamber and a central bore in said mandrel to supply pressurized fluid to said piston chamber for actuation of said one carrier and radial expansion of said shoes.

3. In apparatus for stabilizing a tubular string as set forth in claim 2 wherein a cylindrical piston housing extends from said one carrier along said mandrel to define the piston chamber, and stops are positioned on said housing and said mandrel to limit the longitudinal movement of said one carrier.

4. In apparatus for stabilizing a tubular string as set forth in claim 1 wherein a coiled compression spring is mounted about the mandrel between said carriers for continuously urging said carriers away from each other.

5. In a tubular workstring adapted to be lowered within casing of a well bore for cutting the casing including a tubular mandrel adjacent the lower end of the workstring, and a cutting tool assembly mounted on the mandrel adjacent the lower end thereof and having a plurality of circumferentially spaced cutting blades thereon for cutting casing at a predetermined depth upon rotation of the workstring during the cutting operation;

an improved stabilizer mounted on said mandrel above the cutting tool assembly for accurately positioning and maintaining the cutting tool assembly laterally within the casing during the cutting operation; said stabilizer comprising:

a pair of sleeve-like carriers mounted on said mandrel in longitudinally spaced relation to form upper and lower carriers, one of said carriers being mounted for sliding movement along the mandrel relative to the other carrier;

each of said carriers including a body secured to said mandrel for rotation therewith, a housing mounted on the body, and bearing means between the body and housing permitting relative rotation therebetween;

a plurality of circumferentially spaced shoes between the carriers positioned radially outwardly of said mandrel and adjacent the inner peripheral surface of the casing;

separate linkage means for each of the carriers extending between the shoes and the housing of each carrier for urging said shoes radially outwardly into engagement with the inner peripheral surface of said casing upon longitudinal movement of said one carrier along the mandrel toward the other carrier and permitting rotation of the mandrel and carrier bodies relative to the shoes when said shoes are in engagement with the casing; and fluid pressure actuated means associated with said one carrier and responsive to fluid pressure from the mandrel to urge said one carrier toward the other carrier for radially expanding said shoes.

6. In a tubular workstring as set forth in claim 5 wherein said linkage means for each of the carriers comprises a plurality of links pivotally connected to and extending between the shoes and the housing of each respective carrier.

7. In a tubular workstring as set forth in claim 5 wherein said one carrier includes a sleeve about the mandrel in concentric spaced relation thereto to provide an annular space between the mandrel and sleeve;

a piston in said annular space adjacent the body of said one carrier mounted for sliding movement relative to the mandrel, and a separate fixed sealing member in said annular space secured to said mandrel and spaced from the piston for forming a fluid chamber therebetween; and a fluid port extending between the piston chamber and central bore in said mandrel to supply pressurized fluid to said piston chamber for longitudinal movement of said one carrier toward the other carrier and radial expansion of said shoes into contact with the inner periphery of said casing.

8. In a tubular workstring adapted to be lowered within casing of a well bore for cutting the casing including a tubular mandrel adjacent the lower end of the workstring, and a cutting tool assembly mounted on the mandrel adjacent the lower end thereof and having a plurality of circumferentially spaced cutting blades thereon for cutting casing at a predetermined depth upon rotation of the workstring during the cutting operation;

an improved stabilizer mounted on said mandrel above the cutting tool assembly for accurately positioning and maintaining the cutting tool assembly laterally within the casing during the cutting operation; said stabilizer comprising:

a pair of sleeve-like carriers mounted on said mandrel in longitudinally spaced relation to form upper and lower carriers, one of said carriers being mounted for sliding movement along the mandrel relative to the other carrier;

each of said carriers including a body secured to said mandrel for rotation therewith, a housing mounted on the body and bearing means between the body and housing permitting relative rotation therebetween;

a plurality of circumferentially spaced shoes between the carriers positioned radially outwardly of said mandrel and adjacent the inner peripheral surface of the casing;

a plurality of links pivotally connected to and extending between the shoes and the housing of each carrier for urging said shoes radially outwardly into engagement with the casing upon longitudinal movement of said one carrier along the mandrel toward the other carrier and permitting relative rotation of the mandrel;

said one carrier including a sleeve extending from the associated body in concentric spaced relation to the mandrel to provide an annular space between the mandrel and sleeve;

a piston in said annular space adjacent the body of said one carrier mounted for sliding movement relative to the mandrel, and a separate fixed sealing member in said annular space secured to said mandrel and spaced from the piston for forming a fluid chamber therebetween; and a fluid port extending between the piston chamber and central bore in said mandrel to supply pressurized fluid to said piston chamber for longitudinal movement of said one carrier toward the other carrier and radial expansion of said shoes into contact with the inner periphery of said casing.

* * * * *